United States Patent [19]

Noguchi et al.

[11] 4,444,376

[45] Apr. 24, 1984

[54] MULTI-PIPE TYPE QUENCHING APPARATUS

[75] Inventors: Harumi Noguchi, Kamakura; Kazuo Atago, Yokohama; Katsumi Sakurai, Kawasaki; Tatsuo Ono, Yokohama, all of Japan

[73] Assignee: Nippon Kokan Kabushiki Kaisha, Tokyo, Japan

[21] Appl. No.: 529,668

[22] Filed: Sep. 6, 1983

Related U.S. Application Data

[63] Continuation of Ser. No. 399,252, Jul. 19, 1982, abandoned.

[30] Foreign Application Priority Data

Jul. 20, 1981 [JP] Japan ..... 56-112220

[51] Int. Cl.³ ..... C21D 9/08

[52] U.S. Cl. ..... 266/117; 266/259; 148/155

[58] Field of Search ..... 266/111-113, 266/114-117; 148/131, 143, 153, 155; 62/64; 137/34, 36, 37

[56] References Cited

U.S. PATENT DOCUMENTS

| | | | |
|---|---|---|---|
| 2,834,592 | 5/1958 | Adair et al. | 266/117 |
| 3,623,716 | 11/1971 | Fritsch et al. | 134/147 |
| 3,804,390 | 4/1974 | Jennings et al. | 266/117 |
| 3,877,685 | 4/1975 | Franceschina et al. | 266/114 |
| 4,116,716 | 9/1978 | Itoh | 134/134 |
| 4,336,924 | 6/1982 | Day | 266/117 |

*Primary Examiner*—L. Dewayne Rutledge
*Assistant Examiner*—Christopher W. Brody
*Attorney, Agent, or Firm*—Fleit, Jacobson, Cohn & Price

[57] ABSTRACT

A multi-pipe quenching apparatus for simultaneously quenching a plurality of steel pipes at a high speed. The apparatus comprises (a) a steel pipe holding table for holding a plurality of steel pipes arranged in parallel which table is provided with a plurality of sets each including a plurality of clamp means for clamping a steel pipe at a plurality of points in the lengthwise direction thereof, and cooling water supply means for supplying water into said pipe through a nozzle pressed thereagainst, and (b) a quenching tank capable of containing water up to a predetermined level as occasion demands; whereby the holding table is vertically moved into and out of the quenching tank and the supply of water into the steel pipes is controlled by the cooling water supply means thereby quenching the steel pipes.

2 Claims, 5 Drawing Figures

MULTI-PIPE TYPE QUENCHING APPARATUS

This application is a continuation division of application Ser. No. 399,252, filed July 19, 1982.

BACKGROUND OF THE INVENTION

The present invention relates to quenching apparatus for steel pipes and more particularly to a multi-pipe type quenching apparatus designed to quench a plurality of steel pipes simultaneously.

In the past, there has been known a quenching apparatus for steel pipes (hereinafter simply referred to as pipes) which quenches steel pipes by a so-called inner surface quenching method. In this apparatus, pipes are quenched one by one by clamping the ends of each pipe and supplying water through the pipe and its operating efficiency is low due to the unidirectional cooling which cools the pipe from inside.

To overcome this deficiency, another method has been proposed in which pipes are quenched by the process of immersing each pipe in a water tank. While pipes of large diameters can be quenched satisfactorily by this apparatus, in the case of small-diameter pipes the water is changed into vapor within the pipe so that voids are created and the draining of the water is deteriorated. As a result, each pipe is immersed into the water to quench both the inner and outer surfaces and at the same time the pipe ends are clamped so as to pass the water through the pipe and thereby increase the internal water velocity. However, the required treating time is still long due to the pipes being treated one by one.

Thus, the prior art quenching apparatus are inferior in quenching efficiency and also they are disadvantageous in that the operation of clamping the ends of a pipe for passing the water therethrough causes a bend in the pipe.

SUMMARY OF THE INVENTION

It is the primary object of the present invention to provide a multi-pipe quenching apparatus which overcomes the foregoing deficiencies in the prior art quenching apparatus, is excellent in quenching efficiency and is capable of preventing the occurrence of a bend in pipes.

In accordance with the present invention, a plurality of pipes are arranged and supported on a pipe holding table and the vertical movement of the pipe holding table in and out of a quenching tank capable of containing water up to a given level as desired is controlled, thereby quenching a plurality of pipes simultaneously. Also, attached to each pipe is cooling water supply means including a nozzle pressed against the pipe end through a seal and thus a sufficient cooling rate can be obtained by increasing the flow velocity of the cooling water. By thus quenching a plurality of pipes simultaneously and increasing the inner water flow velocity to increase the cooling rate, it is possible to improve the quenching efficiency greatly.

The pipe holding table is provided with clamp means and each pipe is clamped at a plurality of points in the lengthwise direction thereby holding the pipe by force. Thus, there is no danger of causing a bend in the pipe during the quenching.

Further, by suitably controlling the supply of water to the quenching tank, it is possible to effect the inner and outer surface quenching each in its proper way.

Other objects and advantageous of the invention will be apparent from the following description, the appending claims and the accompanying drawings.

DESCRIPTION OF THE PREFERRED EMBODIMENTS

Figure 1:
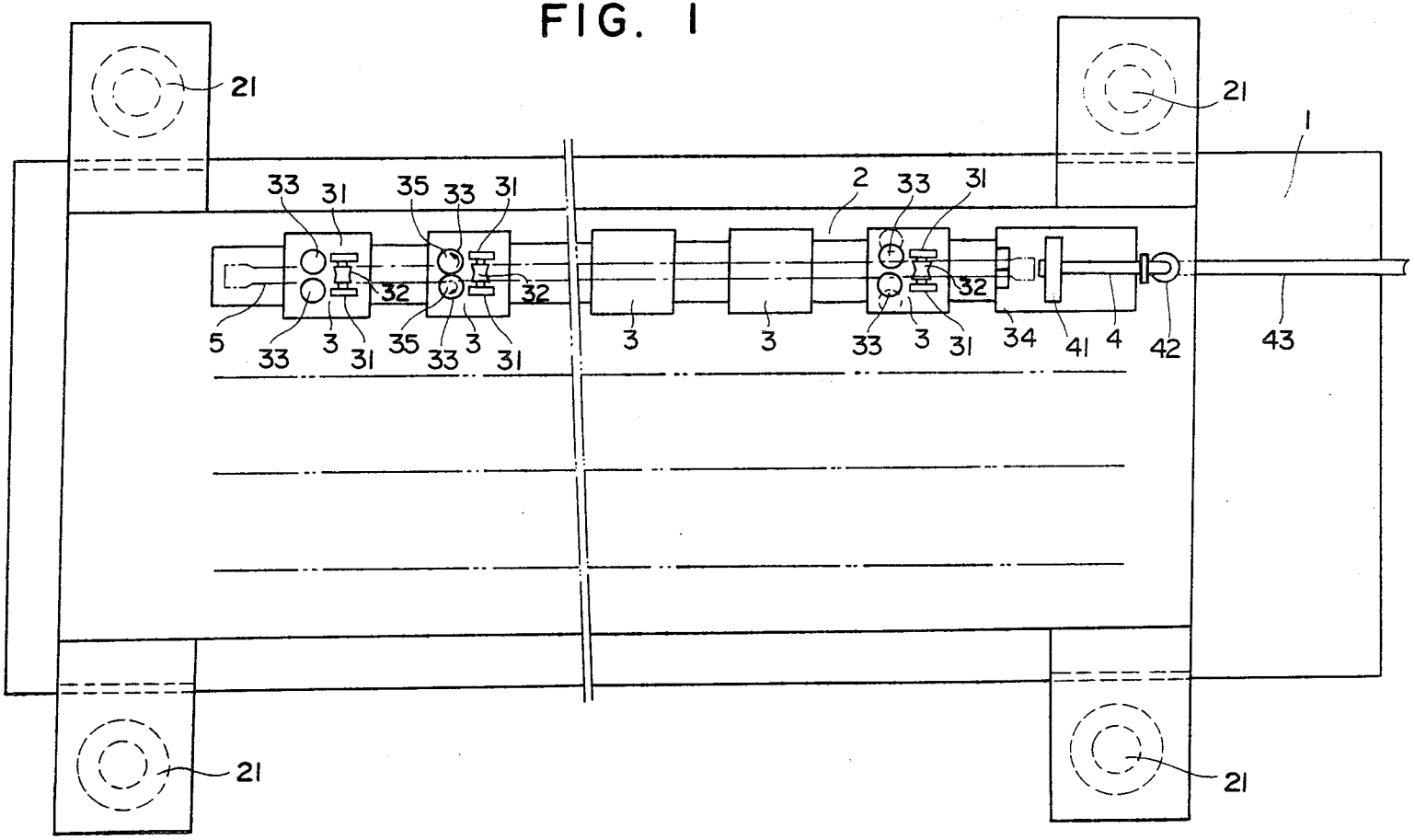
FIG. 1 is a schematic plan view of a multi-pipe quenching apparatus according to the invention.
Figure 2:
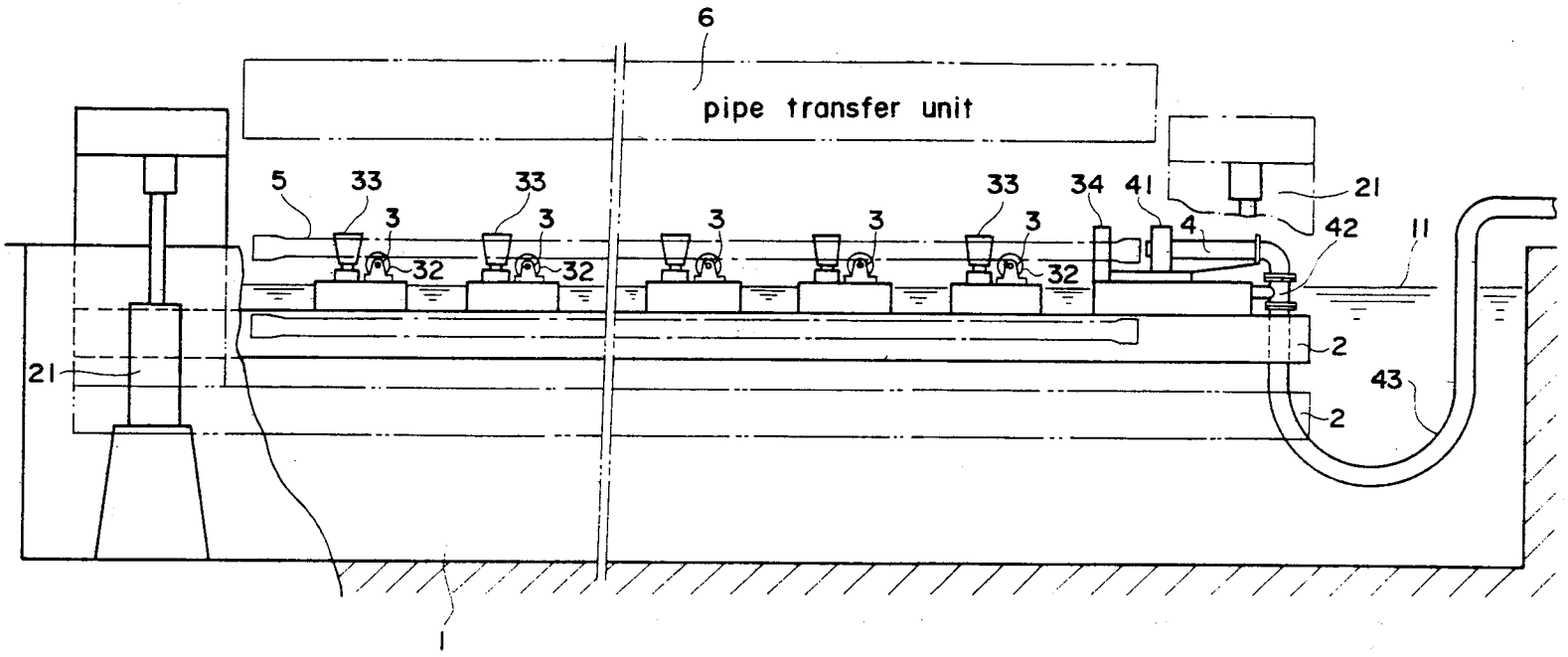
FIG. 2 is a side view of the apparatus shown in FIG. 1.
Figure 3:
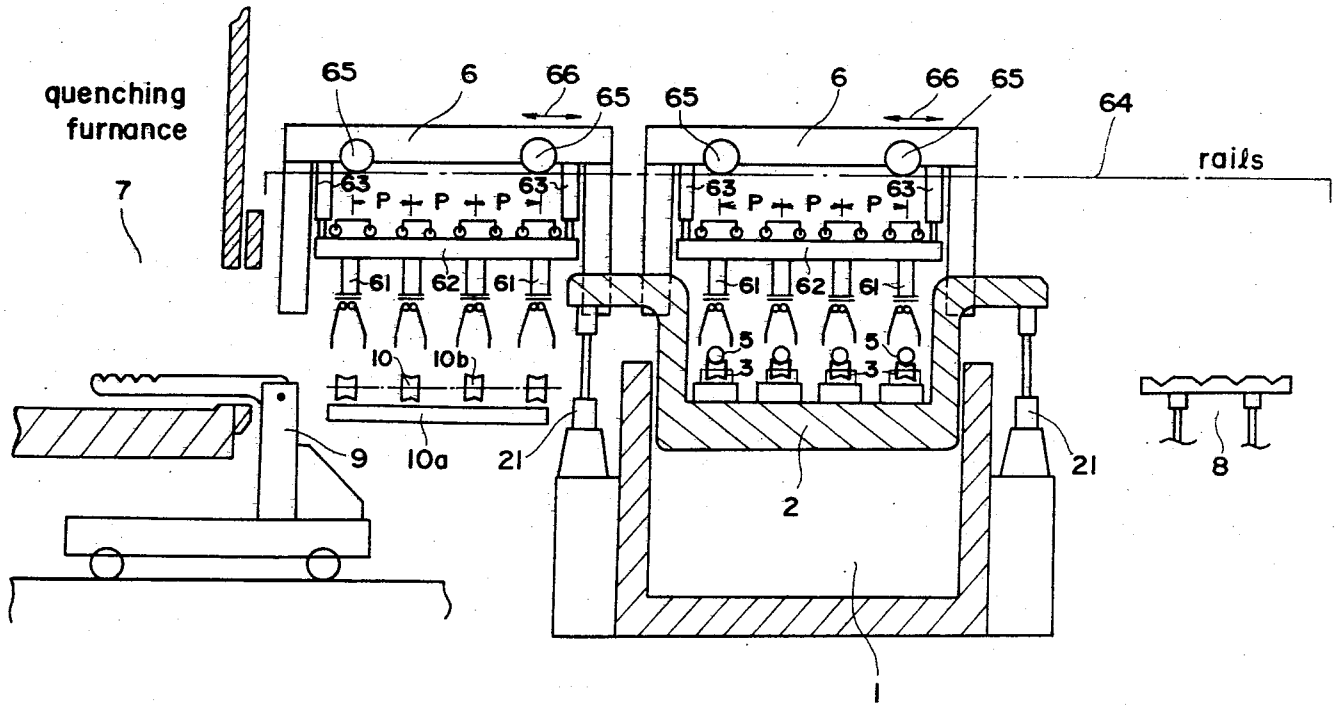
FIG. 3 is a sectional view for explaining the operation of the apparatus according to the invention.

Referring to FIGS. 1, 2 and 3, a pipe holding table 2 is disposed in the upper part of a quenching tank 1, and arranged on the pipe holding table 2 are pipe body clamps 3 and cooling water supply means 4. Although not shown in detail, the quenching tank 1 is constructed so that the water surface is adjustable to a given water level in case of need. The pipe holding table 2 is provided with a lifting cylinder 21 at each of its corners and the vertical movement of the pipe holding table 2 is controlled so as to raise or lower the pipe holding table 2 into the quenching tank 1. The plurality of pipe body clamps 3 are mounted along the lengthwise direction of a pipe 5 to be placed. Since a plurality of pipes are arranged, a plurality of rows of the pipe body clamps 3 are mounted, although only one of the rows is shown. Each of the pipe body clamps 3 comprises a supporting roll 32 mounted through bearings 31 and inverted frustoconical clamp rolls 33 driven by a hydraulic cylinder or the like to grip and clamp the pipe 5 placed on the roll 32. With this construction, the pipe body clamps 3 forcibly restrains any bending of the pipe 5 during the quenching. Also, a pipe end clamp 34 is provided at a place corresponding to the end of the pipe 5 on the side of the cooling water supply means 4. That portion of the pipe end clamp 34 which holds the pipe 5 is adapted to the shape of the pipe 5 so that a nozzle 41 of the cooling water supply means 4 is pressed against the pipe 5 and the pipe 5 is held stationary even if the water velocity within the pipe 5 is increased.

The cooling water supply nozzle 41 of the cooling water supply means 4 is constructed so that it is pressed by an air cylinder (not shown) against the pipe open end through a seal (not shown) so as to ensure a sufficient flow velocity of the water within the pipe and hence a sufficient cooling rate. A cooling water valve 42 and a hose 43 are connected to the nozzle 41 at the back thereof.

A pipe transfer unit 6 is arranged above the pipe holding table 2. The pipe transfer unit 6 comprises pipe holding arms 61, a pipe holding arm support 62 to which are attached the pipe holding arms 61 and hydraulic cylinders 63 for controlling the vertical movement of the support 62. A variable pitch mechanism is provided for the holding arms 61 and thus the pitch of the four pipe holding arms 61 is variable. In this embodiment, two of the pipe transfer unit 6 are used so that the pipes 5 emerging from a quenching furnace are held and transferred by one unit to and above the holding table 2 and after the completion of the quenching the pipes 5 on the holding table 2 are held and transferred to a draining unit 8 by the other unit. Each of the pipe transfer unit 6 is driven by a drive (not shown) so that it is moved in the directions of an arrow 66 by means of wheels 65 over rails 64.

The discharge of pipes 5 from the quenching furnace 7 is effected by a pipe discharge unit 9 and the pipes 5 discharged by the unit 9 are placed on pipe supporting rolls 10*a* of a pipe aligning device 10. The pipe aligning device 10 includes a variable pitch mechanism 10*b* for adjustment of the pitch of the pipe holding arms 61 on the pipe transfer unit 9.

With the construction described above, the operation of the multi-pipe quenching apparatus will now be described. The pipes 5 in the quenching furnace 7 are first discharged by the pipe discharge unit 9. The discharged pipes 5 are rearranged by increasing the pitch of pipe arrangement through the pipe aligning device 10. The rearranged pipes 5 are gripped and raised by the pipe holding arms 61 of the pipe transfer unit 6, transferred to and above the holding table 2 and then lowered and placed on the supporting rolls 32 on the pipe holding table 2.

The body portions of the placed pipes 5 are clamped by the clamp rolls 33 of the pipe body clamps 3 and also their pipe ends are clamped by the pipe end clamps 34. Then the cooling water supply nozzles 41 are pressed against the pipe ends. In this condition, the lifting cylinders 21 are operated so that the pipe holding table 2 is lowered into the quenching tank 1 containing water up to the water surface 11 and as soon as the pipes 5 reach the water surface 11 the cooling water valves 42 are opened thus simultaneously supplying the cooling water into the four pipes and thereby commencing the quenching. After a predetermined time, the holding table 2 is raised and also the cooling water valves 42 are closed thus stopping the water supply. This completes the quenching of the four pipes.

Then, the pipes 5 on the pipe holding table 2 are transferred by the pipe transfer unit 6 to the draining unit 8 thereby draining the water. In this case, the pipe arranging pitch of the draining unit 8 is smaller than that of the holding table 2 so that the pipes gripped by the pipe transfer unit 6 are first adjusted to the pitch of the draining unit 8 by the variable pitch mechanism and then the pipes are lowered. The other pipe transfer unit 6 transfers and places the pipes 5 newly discharged from the quenching furnace 7 on the holding table 2. Thereafter, a plurality of pipes are quenched simultaneously by the same operations as mentioned previously and the operations are repeated continuously.

In the above-described embodiment, the clamp rolls 33 are formed into an inverted frustoconical shape and each pipe 5 is clamped in a wedge gap formed by each of the clamp roll pairs which are arranged at a plurality of points in the lengthwise direction of the pipe thereby preventing the pipe from being ejected, oscillated or bent. Also, a unidirectional rotating mechanism is provided for the clamp rolls 33 allowing each clamp roll 33 to rotate only in the direction of an arrow 35 and consequently each clamp roll 33 is prevented from rotating in the opposite direction due to an internal pressure produced when the cooling water is supplied into the pipe 5. Thus, the pipe 5 is held in position and there is no danger of the nozzle 41 disengaging with the pipe and causing leakage of the high pressure cooling water and cracks in the pipe itself or the adjacent pipe or pipes. When the pipe 5 shrinks upon cooling, each of the clamp rolls 33 rotates in the direction of the arrow 35 in response to the shrinkage and thus there is no danger of damaging the outer surface of the pipe 5. Then, when the pipe 5 is quenched so that the pipe 5 is elongated while slipping over the surface of the clamp rolls 33, there is no danger of damaging the outer surface of the pipe 5 since the pipe outer surface has already been hardened by the quenching. Note that where the pipes can be clamped satisfactorily by the pipe body clamps alone depending on the quenching conditions, the pipe end clamps need not be provided.

While, in the embodiment described above, water is contained in the quenching tank 1 and both the inner and outer surfaces of pipes are quenched, by draining the water in the quenching tank 1 or by not lowering the holding table 2, it is possible to effect only the inner surface quenching. Further, while four pipes are quenched simultaneously, the number of pipes needs not be limited to four.

Figure 4:
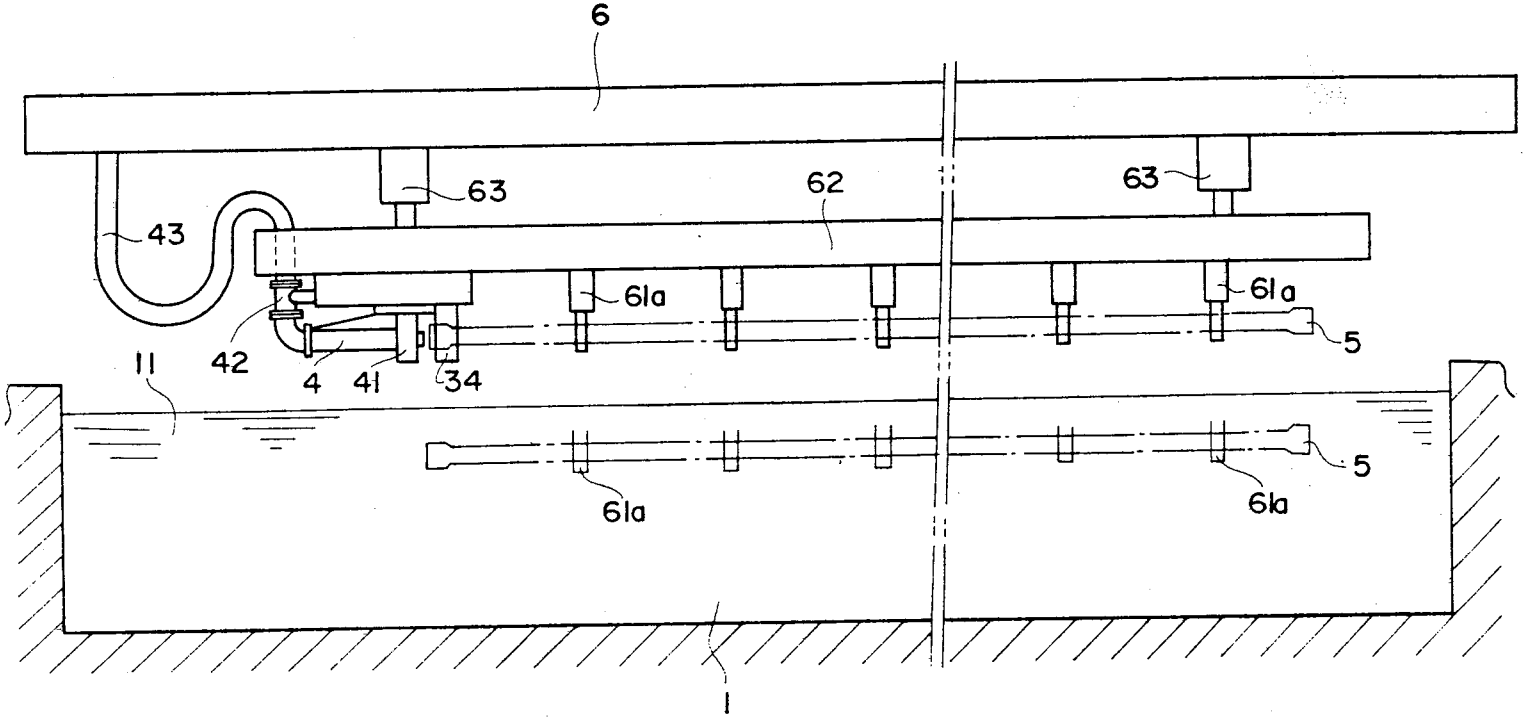
FIG. 4 shows a modification of a pipe transfer unit.

Further, while the pipes 5 are clamped on the pipe holding table 2 and placed in the quenching tank 1, it is possible to eliminate the pipe holding table 2 and operate the hydraulic cylinders 63 in a manner that the pipes 5 gripped by the pipe holding arms 61*a* are placed in the quenching tank 1 as shown in FIG. 4, for example. In this case, the cooling water supply means 4 are attached to the pipe holding arm support 62. Of course, the pipe holding arms 61*a* must be constructed so as to satisfactorily clamp the pipes 5 and in this respect they differ from the pipe holding arms 61 used in the above-mentioned embodiment.

Figure 5:
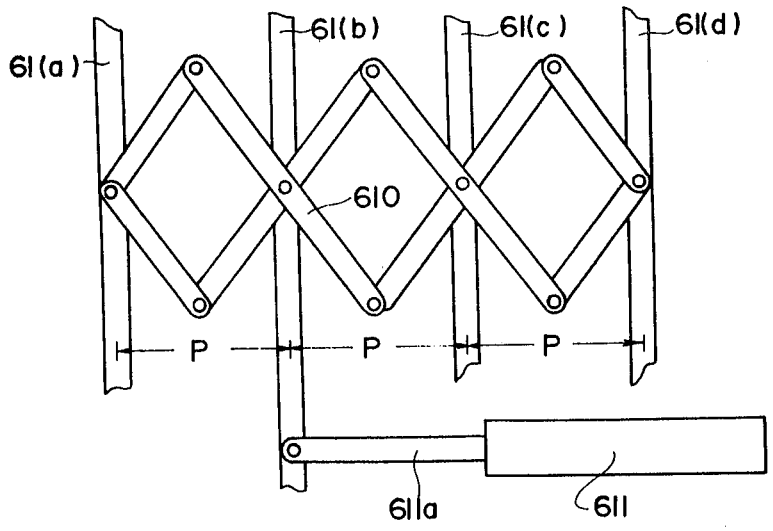
FIG. 5 shows the construction of a pipe holding arm variable pitch mechanism.

Further, while, in the above-described embodiment, the construction of the variable pitch mechanism for the pipe holding arms 61 is now shown, the construction will now be described with reference to FIG. 5. A pantagraph 610 is attached to each group of the pipe holding arms 61 and a piston rod 611*a* of a hydraulic cylinder 611 is connected to one of the arms or 61(*b*). The cylinder 611 is fixed to the pipe holding arm support 62 and the pipe holding arm 61(*a*) which is on the left side in the Figure is also fixed with respect to the pitch direction. When the hydraulic cylinders 611 are operated so that the pipe holding arms 61(*b*) connected to the piston rods 611*a* are moved, the pipe holding arms 61(*c*) and 61(*d*) which are on the right side of the pipe holding arms 61(*b*) are also moved in association with the pipe holding arms 61(*b*) by the pantagraphs 610, thereby changing the pitch P.

The variable pitch mechanism 10*b* of the pipe aligning device 10 is for example constructed so that each of the pipe supporting rolls 10*a* is connected to separate actuating means and the actuating means are connected to a single driving unit and a single reduction gear or the like. Thus, by varying the amount of movement per unit time of the actuating means, it is possible to easily arrange the pipe supporting rolls 10*a* with any desired pitch. Each of the actuating means may be comprised for example of a combination of a chain and sprockets.

What is claimed is:

1. A multi-pipe quenching apparatus comprising:

(a) a steel pipe holding table for holding a plurality of steel pipes arranged in parallel, which table is provided with a plurality of sets each including a plurality of clamp means for clamping a steel pipe at a plurality of points in the lengthwise direction thereof, each of said clamp means comprising a supporting role for placing a steel pipe thereon and a pair of inverted frustoconical clamp rolls for clamping said steel pipe, and cooling water supply means for supplying water into said pipe through a nozzle pressed thereagainst, said clamp rolls including means to permit said rolls to rotate in only one direction and thereby prevent disengagement of said pipe from said nozzle;

(b) a quenching tank capable of containing water up to a predetermined level as occasion demands;

(c) pipe transfer means arranged above said steel pipe holding table, said pipe transfer means comprising a plurality of pipe holding arms, a pipe holding arm support having said holding arms attached thereto, a plurality of hydraulic cylinders for controlling the vertical movement of said support, and variable pitch means connected to said plurality of pipe holding arms;

(d) alignment means having variable pitch means attached thereto and arranged on a pipe entry side of said pipe transfer means; and whereby said pipe holding table is lowered into and raised from said quenching tank and the supply of water is controlled by said cooling water supply means thereby quenching said steel pipes.

2. An apparatus according to claim 1, wherein at least four lifting cylinders are attached to said steel pipe holding table.

* * * * *